US005342745A

United States Patent [19]

Tai et al.

[11] Patent Number: 5,342,745

[45] Date of Patent: Aug. 30, 1994

[54] LIGHT-SENSITIVE SILVER HALIDE COLOR PHOTOGRAPHIC MATERIAL

[75] Inventors: Akiyoshi Tai; Shun Takada, both of Odawara, Japan

[73] Assignee: Konica Corporation, Tokyo, Japan

[21] Appl. No.: 136,469

[22] Filed: Oct. 13, 1993

[30] Foreign Application Priority Data

Oct. 21, 1992 [JP] Japan ..... 4-283035

[51] Int. Cl.[5] ..... G03C 1/775

[52] U.S. Cl. ..... 430/538; 430/262; 430/263; 430/536; 430/531

[58] Field of Search ..... 430/523, 531, 536, 538, 430/262, 263

[56] References Cited

U.S. PATENT DOCUMENTS 4,645,736 2/1987 Anthonson et al. ..... 430/538
4,821,781 5/1990 Takamuki et al. ..... 430/538
5,051,335 9/1991 Katz ..... 430/538
5,252,424 10/1993 Sato et al. ..... 430/538
5,359,450 10/1993 Lalz et al. ..... 430/538

*Primary Examiner*—Jack P. Brammer
*Attorney, Agent, or Firm*—Jordan B. Bierman

[57] ABSTRACT

Disclosed is a silver halide photographic light-sensitive material comprising a base paper support coated with a hydrophilic polymer as a peeling agent, and having thereon, a polyolefin resin layer, and at least one silver halide emulsion layer, wherein the hydrophilic polymer is coated on the side on which the silver halide emulsion layer is provided, and a peel strength between the base paper support and the polyolefin resin layer is within the range of 30 to 160 g in weight per inch, and a maximum color transmission density is not less than 2.0 when the silver halide light-sensitive material is subjected to a color developing.

13 Claims, No Drawings

LIGHT-SENSITIVE SILVER HALIDE COLOR PHOTOGRAPHIC MATERIAL

FIELD OF THE INVENTION

This invention relates to a light-sensitive silver halide color photographic material, and more particularly to a highly general-purpose light-sensitive silver halide color photographic material for transmission photodisplay, promising a superior image quality when light-transmitted from the back, and having a superior adaptability to automatic processors

BACKGROUND OF THE INVENTION

In recent years, display using color photographs is increasing in department stores, subway platforms, restaurants, lobbies of hotels, and so forth.

Under certain conditions as in dark rooms or in the open air at night, such photographs are commonly displayed by transmission systems in which images are viewed through irradiation with light from the back thereof, where light-sensitive display materials exclusively used for transmission types are used.

Supports of such transmission type light-sensitive display materials are usually limited to their use in a display system in which films are put in light boxes and images are viewed through light shed from the back. For this reason, it has been sought to make an advance of transmission type light-sensitive display materials having more general-purpose properties for display methods. In particular, it has been sought to make an advance of supports that can substitute polyethylene terephthalate bases usually used in transmission type light-sensitive display materials in view of general-purpose properties.

The present inventors made various studies also on the supports. Support paper for general use, however, does not transmit the light shed from the back, and can not be used as a support of the transmission type light-sensitive display materials. Meanwhile, they also made studies on thin base paper supports. The thin base paper supports can provide a better image quality when light-transmitted from the back than the base paper supports for general use, but have an unsatisfactory clearness compared with the polyethylene terephthalate bases. They have also disadvantages that they show a poor transport performance at the time of the processing using an automatic processor and have a poor anti-curl performance before and after the processing.

SUMMARY OF THE INVENTION

Accordingly, an object of the present invention is to provide a highly general-purpose light-sensitive silver halide color photographic material for transmission photodisplay, promising a superior image quality when light-transmitted from the back, having a superior adaptability to automatic processors and having a superior anti-curl performance.

The above object of the present invention can be achieved by a light-sensitive silver halide photographic material comprising a support comprised of a base paper coated with a hydrophilic polymer on its side on which an emulsion layer is provided and a polyolefin resin layer superposed on the base paper so that the adhesion between the base paper and the polyolefin resin layer is in a peel strength of from 30 to 160 g in weight per inch, and at least one silver halide emulsion layer provided on the support; said light-sensitive silver halide photographic material having a maximum color transmission density of 2.0 or more after it has been subjected to color developing.

DETAILED DESCRIPTION OF THE INVENTION

The present invention will be described below in detail.

The support according to the present invention is comprised of a base paper as a basic component, coated with a hydrophilic polymer on its side on which a silver halide emulsion layer is provided, and thereafter further coated with a polyolefin resin on the both sides of the base paper so that the layer of the polyolefin resin on the side of a silver halide emulsion layer is separable from the base paper with ease.

The adhesion between the base paper and the polyolefin resin layer is in a peel strength of from 30 to 160 g in weight per inch. This peel strength is measured by the measuring method prescribed in ASTM D-903 of American Society for Testing and Materials. An upper limit of the peel strength may be set taking account of the readiness in peeling when the light-sensitive material is stuck to a transfer medium after its photographic processing, and a lower limit thereof, taking account the prevention of separation in the course of processing steps. It may preferably be in the range of from 40 to 120 g in weight per inch.

The hydrophilic polymer used as a release agent in the present invention may include hydrophilic polymers commonly used. It may preferably include the following polymers.

(1) Polymeric compounds containing cellulose as a constituent.

(2) Polymeric compounds containing vinyl acetate as a constituent.

(3) Polymeric compounds containing vinyl alcohol as a constituent.

(4) Polymeric compounds containing acrylic acid or maleic acid as a constituent.

With regard to the hydrophilic polymers containing cellulose as a constituent, they may preferably be polymers of cellulose ethers or cellulose esters, having a molecular weight of from 1,000 to 1,000,000 as exemplified by methyl cellulose, ethyl cellulose, benzyl cellulose, carboxymethyl cellulose, acetyl cellulose, cellulose sulfate and cellulose phthalate.

With regard to the hydrophilic polymers containing vinyl acetate as a constituent, the component for copolymerization may be any of those copolymerizable with the vinyl acetate. These are usually used in the form of what is called emulsions in which they are dispersed in water. In general, these may preferably have a molecular weight of from 1,000 to 1,000,000. Those having a molecular weight of less than 1,000 may have an extremely poor adhesive strength. On the other hand, those having a molecular weight of more than 1,000,000 may have an extremely poor coating suitability to make it difficult to be put into practical use. Examples of the polymeric compounds having vinyl acetate as a constituent can be polyvinyl acetate, an ethylene/vinyl acetate copolymer, a carboxyl-modified ethylene/vinyl acetate copolymer, a vinyl acetate/vinyl chloride copolymer, a vinyl acetate/acrylic acid copolymer and a vinyl acetate/maleic acid copolymer.

As the polymeric compounds containing vinyl alcohol as a constituent, polyvinyl alcohol alone or copolymers of vinyl alcohol with other monomers can be used. As to their molecular weight, there are no particular limitations on its range. In general, it may preferably be in the range of from 100 to 100,000. Examples of the polymeric compounds containing vinyl alcohol as a constituent can be polyvinyl alcohol and an ethylene/-vinyl alcohol copolymer.

With regard to the polymeric compounds comprising a polymer of acrylic acid or maleic acid, examples thereof can be polyacrylic acid, sodium polyacrylate, polymethyl acrylate, polymaleic acid, polymethyl maleate and a sulfone/maleic acid copolymer. As to their molecular weight, there are no particular limitations on its range. It may preferably be in the range of from 10,000 to 1,000,000.

Of the release agents described above, preferred examples are carboxymethyl cellulose, methyl cellulose, polyvinyl alcohol and an ethylene/vinyl alcohol copolymer.

The release agent described above is coated on the surface of the photographic base paper in a coating weight of from 0.5 to 1.5 g/m$^2$. It may be coated by gravure coating, bar coating, air-knife coating, curtain coating or the like usually used in the art.

The base paper of the present invention may be selected from materials commonly used in photographic papers. For example, the materials may include natural pulp, synthetic pulp, mixtures of natural pulp and synthetic pulp, and also various kinds of combination materials. In general, natural pulp mainly composed of needle-leaved tree pulp, broad-leaved tree pulp, or a mixed pulp of needle-leaved tree pulp and broad-leaved tree pulp can be widely used.

In the support described above, additives such as a sizing agent, a fixing agent, a reinforcing agent, a filler, an antistatic agent and a dye may be mixed. The support may also be appropriately coated with a surface-sizing agent, a surface-strengthening agent, an antistatic agent and so forth on its surface.

The support used may have a smooth surface, usually having a basis weight of from 50 to 300 g/m$^2$. The support is coated with the above release agent on at lease one side thereof, and thereafter further coated with the polyolefin resin on its both sides. The polyolefin resin may be selected from polyethylene, $\alpha$-olefins, homopolymers as exemplified by polypropylene, copolymers of at least two kinds of the olefins, or mixtures of at least two kinds of these various polymers. Particularly preferred polyolefin resins are low-density polyolefin and high-density polyolefin, or mixtures of these.

There are no particular limitations on the molecular weight of the polyolefin resin. In usual instances, polyolefin resins with a molecular weight ranging from 20,000 to 200,000 are used.

The polyolefin resin layer formed on the support according to the present invention on its side on which photographic emulsions are coated may preferably have a thickness of from 25 to 50 $\mu$m, and more preferably from 25 to 35 $\mu$m.

The polyolefin used for its coating on the back surface (the side opposite to the side on which emulsion layers are provided) of the support is usually comprised of a mixture of a low-density polyethylene and a high-density polyethylene, which mixture itself is melt-coated. The resulting layer is commonly often subjected to matting.

In the polyolefin resin used for its coating on the top surface (the side on which emulsion layers are provide) of the support, a white pigment is dispersedly mixed in an amount of from 13 to 20% by weight.

As the white pigment, inorganic and/or organic white pigments may be used, and inorganic white pigments are preferred. Such pigments may include alkaline earth metal sulfates such as barium sulfate, alkaline earth metal carbonates such as calcium carbonate, finely divided silicate, silicas of synthetic silicates, calcium silicate, alumina, alumina hydrates, titanium oxide, zinc oxide, talc and clay.

Of these, barium sulfate, calcium carbonate and titanium oxide are preferred, and barium sulfate and titanium oxide are more preferred.

The titanium oxide may be of either a futile type or an anatase type. Titanium oxide whose particle surfaces have been coated with a metal oxide such as hydrated alumina and hydrated ferrite.

In addition, various additives such as a color pigment, a fluorescent brightener and an antioxidant may be added.

When the coat layers are formed on the top and back surfaces of the support, the resin layer on the top surface side may be made to have a little higher density than that on the back surface or the coating weight on the back surface may be made larger than that on the top surface. Such means are commonly taken in order to increase the flatness of photographically processed photographic papers in ordinary use environments.

The coat layers on both the top surface and the back surface of the support can be commonly formed by applying a polyolefin resin composition onto the support by melt extrusion coating. To carry Out this melt extrusion coating, the polyolefin resin composition is usually melt-extruded on a running support from a slit die of an extruder so as to be coated in the form of a film of a single layer or plural layers. The melt extrusion may usually be carried out at a temperature of from 200° to 350° C. The top surface, or optionally the both top and back surfaces, of the support may be subjected to corona discharge treatment, flame treatment or the like. If necessary, a subcoat layer may also be provided on the surface of the top surface coat layer to improve its adhesion to a photographic emulsion layer or a back coat layer may be provided on the back surface coat layer to improve its print writability and antistatic properties.

The support may preferably have a thickness of 150 $\mu$m or larger, and more preferably 200 $\mu$m or larger.

The light-sensitive silver halide photographic material of the present invention has a maximum color transmission density of 2.0 or more. What is meant by the maximum color transmission density of 2.0 or more herein referred is that, when blue (B), green (G) and red (R) densities of a sample obtained by subjecting the light-sensitive silver halide photographic material to imagewise exposure to white light followed by color developing are measured using a PDA-65 (manufactured by Konica Corporation) in the state the side provided with emulsion layers faces the detector, the values of B, G and R densities obtained by subtracting densities at non-image portions from the values obtained by the measurement are all 2.0 or more.

In the case of the transmission type light-sensitive display material, images are viewed through transmission of light shed from the back. Hence, if the maximum color transmission density is less than 2.0, the images may become light and it comes difficult for the light-sensitive material to be used as the transmission type light-sensitive display material. The maximum color transmission density may preferably be 2.2 or more.

The light-sensitive silver halide photographic material of the present invention may have a total silver coating weight of 1.0 g/m$^2$ or more. The total silver coating weight herein referred to is meant to be a total silver coating weight on the emulsion layer side.

If the total silver coating weight is smaller than 1.0 g/m$^2$, it becomes difficult to achieve the maximum color transmission density of 2.0 or more. The total silver coating weight may more preferably be 1.2 g/m$^2$.

The silver halide used in the silver halide emulsion layer according to the present invention may include any silver ha/ides such as silver chloride, silver bromide, silver iodide, silver chlorobromide, silver iodobromide and silver chloroiodobromide.

Silver halide grains preferably used in the present invention have a silver chloride content of not less than 95 mol %, and may preferably have a silver bromide content of not more than 5 mol % and a silver iodide content of not more than 0.5 mol %. The silver halide grains may more preferably comprise silver chlorobromide having a silver bromide content of from 0.1 to 2 mol %. Such silver halide grains may be used alone or may be used in the form of a mixture with other compositionally different silver halide grains. They may also be used in the form of a mixture with silver halide grains having a silver chloride content of not more than 95 mol %.

In a silver halide emulsion layer containing silver halide grains having a silver chloride content of not less than 95 mol %, the silver halide grains having a silver chloride content of not less than 95 mol % may be in a proportion of not less than 60% by weight, and preferably not less than 80% by weight, based on the whole silver halide grains contained in that emulsion layer. The silver halide grains may be compositionally uniform from the grain insides up to the outsides, or may be compositionally different between the grain insides and the outsides. In the case when they are compositionally different between the grain insides and the outsides, the compositional change may be continuous or discontinuous.

The silver halide grains according to the present invention may have any form. A preferable example is a cube having (100) plane as a crystal surface. Grains having the form of octahedrons, tetradecahedrons, dodecahedrons or the like may be prepared by the method disclosed in U.S. Pat. Nos. 4,183,756 and 4,225,556, Japanese Patent Publication Open to Public Inspection No. (hereinafter referred to as Japanese Patent O.P.I. Publication) No. 26589/1980, Japanese Patent Examined Publication No. 42737/1980 or The Journal of The Photographic Science (J. Photogr. Sci.) 21, 39 (1973), end such grains may be used. Grains having twin planes may also be used.

The silver halide Grains according to the present invention may be grains having simple shapes or a mixture of grains having various shapes, any of which may be used.

There are no particular limitations on the grain size of the silver halide grain according to the present invention. Taking account of rapid processability, sensitivity and other photographic performances, the grain size may preferably be in the range of from 0.1 to 1.2 μm, and more preferably from 0.2 to 1.0 μm. The grain size can be measured by various methods commonly used in the present technical field. A typical method include the method disclosed in Loveland, Particle-Size Analytical Method, ASTM Symposium on Light Microscopy, pages 94–122, 1955, or Mees and James, The Theory of The Photographic Process, Third Edition, Chapter 2, Macmillan Publishing Co., Inc., 1966.

This grain size can be measured using projected areas of grains or approximate values of diameters. In the case when the Grains are substantially uniform in their shapes, grain size distribution can be reasonably accurately expressed as diameters or projected areas.

The distribution of grain size of the silver halide grains according to the present invention may be either polydisperse or monodisperse. Preferred are monodisperse silver halide grains having a coefficient of variation of 0.22 or less, and more preferred are those of 0.15 or less. Here, the coefficient of variation is a coefficient that represents the breadth of grain size distribution, and is defined by the following expression.

$$\text{Coefficient of variation} = S/R$$

wherein S represents a standard deviation of grain size distribution, and R represents an average grain size.

The grain size herein referred to indicates a diameter of a grain when it is a spherical silver halide grain or, when it is a grain having the shape other than that of a cube or sphere, a diameter obtained by calculating its projected image into a circular image having the same area.

The silver halide emulsion can be prepared using various apparatus and methods known in the present industrial field.

The silver halide emulsion according to the present invention may be obtained by any of the acidic method, the neutral method and the ammoniacal method. The grains may be grown at one time, or may be grown after seed grains have been produced. The manner by which the seed grains are produced and the manner by which grains are grown may be the same or different.

The mode in which a soluble silver salt and a soluble halide salt are allowed to react may be any of normal precipitation, reverse precipitation, double-jet precipitation, and combinations of these. Emulsions obtained by double-jet precipitation are preferred. As a mode of the double-jet precipitation, the pAg-controlled double-jet precipitation as disclosed in Japanese Patent O.P.I. Publication No. 48521/1979 may also be used.

It is also possible to use an apparatus for feeding an aqueous solution of a water-soluble silver salt and an aqueous solution of a water-soluble halide salt from an addition apparatus provided in reaction mother liquor, as disclosed in Japanese Patent O.P.I. Publications No. 92523/1982 and No. 92524/1982; an apparatus for adding aqueous solutions of a water-soluble silver salt and a water-soluble halide salt while continuously changing their concentrations, as disclosed in German Patent Publication No. 29 21 154; and an apparatus for forming grains while keeping the distance between silver halide grains constant, by taking out mother liquor outside a reaction vessel and concentrating it by ultrafiltration, as disclosed in Japanese Patent Examined Publication No. 501776/1981.

If necessary, a silver halide solvent such as thioether may also be used. Also, a compound having a mercapto group, a nitrogen-containing heterocyclic compound or a compound such as a spectral sensitizer may be used by adding them when silver halide grain are formed or after the formation of grains has been completed.

The silver halide emulsion according to the present invention may be chemically sensitized by reduction sensitization.

The silver halide emulsion according to the present invention may be subjected to the reduction sensitization by using known methods. For example, it is possible to use a method in which various reducing agents are added, a method in which ripening is carried out under conditions of a high silver ion concentration, or a method in which ripening is carried out under conditions of a high pH.

The reducing agent used in the reduction sensitization of the silver halide emulsion according to the present invention may include stannous salts such as stannous chloride, boranes such as tri-t-butylamineborane, sulfites such as sodium sulfite and potassium sulfite, reductones such as ascorbic acid, and thiourea dioxide. Of these, compounds preferably usable may include thiourea dioxide, ascorbic acid and derivatives thereof, and sulfites. Compared with the case when reduction sensitization is carried out while controlling silver ion concentration and pH during the ripening, the method making use of a reducing agent as described above has a superior reproducibility and hence is preferred.

Any of these reducing agents may be added in the silver halide emulsion after it has been dissolved in a solvent such as water or alcohol, to carry out ripening. Alternatively, it may be added when silver halide grains are formed, to carry out reduction sensitization simultaneously with the formation of grains.

The amount of the reducing agent added must be adjusted in accordance with the pH of the silver halide emulsion, the concentration of silver ions and so forth. In usual instances, it may preferably be in a range of from $10^{-7}$ to $10^{-2}$ mol per mol of the silver halide emulsion.

An oxidizing agent may be used in a small amount so that reduction-sensitizing nuclei can be modified after the reduction sensitization or any remaining reducing agent can be deactivated. Compounds used for such purpose may include potassium ferric hexacyanate, bromosuccinimide, p-quinone, potassium perchlorate and hydrogen peroxide.

The silver halide emulsion according to the present invention may be subjected to the reduction sensitization, and also to sensitization making use of a gold compound and sensitization making use of a chalcogen sensitizer which are carried out in combination.

As the chalcogen sensitizer used in the silver halide emulsion according to the present invention, a sulfur sensitizer, a selenium sensitizer and a tellurium sensitizer may be used. A sulfur sensitizer is preferred. The sulfur sensitizer may include thiosulfates, allylthiocarbamidothioureas, allyl isocyanates, cystine, p-toluenethiosulfonates and rhodanine.

As a gold sensitizer used in the silver halide emulsion according to the present invention, it may be added in the form of various gold complexes such as chloroauric acid and gold sulfide. A ligand compound used may include dimethyl rhodenine, thiocyanic acid, mercaptotetrazole and mercaptotriazole. The amount of the gold compound used can not be uniform depending on the type of the compound used and the ripening conditions. In usual instances, it may preferably be in the range of from $1\times10^{-4}$ mol to $1\times10^{-8}$ mol per mol of silver halide. It may more preferably be in the range of from $1\times10^{-5}$ mol to $1\times10^{-8}$ mol.

In the silver halide emulsion according to the present invention, known antifoggants and stabilizers may be used for the purposes of preventing fog from occurring in the course of the preparation of the light-sensitive silver halide photographic material, decreasing variations in performances during storage and preventing fog from occurring at the time of development. Compounds that can be used for such purpose can be exemplified by compounds represented by Formula II disclosed in Japanese Patent O.P.I- Publication No. 146036/1990, page 7, lower column. Specific compounds thereof may include compounds IIa-1 to IIa-8 and IIb-1 to IIb-7 disclosed in the same publication, page 8, and 1-(3-methoxyphenyl)-5-mercaptotetrazole. Depending on the purpose, these compounds may be added in the step of preparing silver halide emulsion grains, in the step of chemical sensitization, at the time when the step of chemical sensitization is completed, or in the step of preparing coating solutions. In the case when chemical sensitization is carried out in the presence of such a compound, the compound may preferably be used in an amount of about $1\times10^{-5}$ mol to about $5\times10^{-4}$ mol per mol of silver halide. In the case when the compound is added at the time when chemical sensitization is completed, it may preferably be in an amount of from about $1\times10^{-6}$ mol to about $1\times10^{-2}$ mol, and more preferably from $1\times10^{-5}$ mol to $5\times10^{-3}$ mol, per mol of silver halide. In the case when the compound is added to silver halide emulsion layers in the step of preparing coating solutions, it may preferably be in an amount of from about $1\times10^{-6}$ mol to about $1\times10^{-1}$ mol, and more preferably from $1\times10^{-5}$ mol to $1\times10^{-2}$ mol, per mol of silver halide. In the case when the compound is added to layers other than the silver halide emulsion layers, it may preferably be in an amount of from about $1\times10^{-9}$ mol to about $1\times10^{-3}$ mol as its amount in a coating layer.

In the case when the light-sensitive silver halide photographic material according to the present invention is used as a color photographic material, it has layers containing silver halide emulsions spectrally sensitized to specific regions of wavelength regions of from 400 to 900 nm in combination of a yellow coupler, a magenta coupler and a cyan coupler. Such silver halide emulsions contain one kind or two or more kinds of spectral sensitizers in combination.

With regard to the spectral sensitizers used in the silver halide emulsion according to the present invention, any known compounds can be preferably used. As blue-sensitive spectral sensitizers, BS-1 to BS-8 disclosed in Japanese Patent Application No. 51124/1990, pages 108–109, may preferably be used alone or in combination. As green-sensitive spectral sensitizers, CS-1 to GS-5 disclosed in the same application, page 110, may preferably be used. As red-sensitive spectral sensitizers, RS-1 to RS-8 disclosed in the same application, pages 111–112, may preferably be used. In instances in which the light-sensitive silver halide photographic material according to the present invention is exposed using a printer making use of a semiconductor laser, a spectral sensitizer having a sensitivity to infrared must be used. As infrared-sensitive spectral sensitizers, IRS-1 to IRS-11 disclosed in Japanese Patent Application No. 73619/1991, pages 12–14, may preferably be used. It is also preferable to use spectral supersensitizers SS-1 to SS-9 disclosed in the same application, pages 14–15, in combination with these dyes.

In the case when the light-sensitive silver halide photographic material according to the present invention is exposed using a laser, it is advantageous in view of making apparatus small-sized to use an exposure device making use of a semiconductor laser. When scanning exposure is carried out, the exposure time per picture element corresponds to the time for which a silver halide emulsion is actually exposed. The exposure time per picture element is meant as follows: In the case of the scanning exposure by laser light, the part at which light intensity comes to be ½ of a maximum value in spatial changes of intensity of the luminous flux of the light is regarded as an outer edge of luminous flux, and the distance between two points at which a line parallel to a scanning line and passing a point at which the light intensity becomes maximum intersects the outer edge of the luminous flux is regarded as a diameter of luminous flux, where the exposure time per picture element may be regarded as:

(diameter of luminous flux)/(scanning speed).

As the exposure time per picture element becomes shorter, the relationship between the exposure time and the color density tends to become complicated. The present invention is particularly effective when an apparatus having a shorter exposure time per picture element is used.

Laser printers that can be considered applicable to such a system may include, for example, those disclosed in Japanese Patent O.P.I. Publications No. 4071/1980, No. 11062/1984, No. 197947/1988, No. 74942/1990 and No. 236583/1990, Japanese Patent Examined Publications No. 14963/1981 and No. 40822/1981, European Patent No. 77410, DENSHI TSUSHIN GAKKAI GIJUTSU KENKYU HOKOKU (Electronic Communication Society, Technical Research Reports), Vol. 80, No. 244, and EIGA TEREBI GIJUTUSHI (Movies & Television Engineering) 1984/6(382), pages 34–36.

In the light-sensitive silver halide photographic material according to the present invention, dyes having absorption in various wavelength regions may be used for the purpose of anti-irradiation or anti-halation. For this purpose, any known compounds may be used. In particular, dyes AI-1 to AI-11 disclosed in Japanese Patent Application No. 51124/1990, pages 117–118, are preferably used as dyes having absorption in the visible region. Compounds represented by Formulas I, II and III disclosed in Japanese Patent O.P.I. Publication No. 280750/1989, page 2, left lower column, are preferable as infrared absorptive dyes since they have preferable spectral characteristics, have no influence on the photographic performances of silver halide photographic emulsions and may cause no stain due to residual colors. Examples of preferable compounds are exemplary compounds 1 to 45 disclosed in the same publication, page 3, left lower column to page 5, left lower column.

As couplers used in the light-sensitive silver halide photographic material according to the present invention, any compounds can be used so long as they are capable of coupling with an oxidized product of a color developing agent to form coupling products having a spectral absorption maximum wavelength in a wavelength region longer than 340 nm. Typical compounds are those known as yellow couplers having a spectral absorption maximum wavelength in a wavelength region of from 350 to 500 nm, magenta couplers having a spectral absorption maximum wavelength in a wavelength region of from 500 to 600 nm, and cyan couplers having a spectral absorption maximum wavelength in a wavelength region of from 600 to 750 nm.

Yellow couplers preferably usable in the light-sensitive silver halide photographic material according to the present invention may include couplers represented by Formula Y-I disclosed in Japanese Patent O.P.I. Publication No. 114152/1992, page 8. Specific compounds may include those disclosed as YC-1 to YC-9 in the same publication, pages 9–11. In particular, YC-8 and YC-9 disclosed in the same publication, page 11, are preferred since they can reproduce yellow with a desirable color tone. Magenta couplers preferably usable in the light-sensitive silver halide photographic material according to the present invention may include couplers represented by Formulas M-I and M-II disclosed in Japanese Patent O.P.I. Publication No. 114152/1992, page 12. Specific compounds may include those disclosed as MC-1 to MC-11 in the same publication, pages 13–16. In particular, MC-8 to MC-11 disclosed in the same publication, pages 15–16, are preferred since they can well reproduce colors ranging from blue, violet to red and also can well represent details.

Cyan couplers preferably usable in the light-sensitive silver halide photographic material according to the present invention may include couplers represented by Formulas C-I and C-II disclosed in Japanese Patent O.P.I. Publication No. 114152/1992, page 17. Specific compounds may include those disclosed as CC-1 to CC-9 in the same publication, pages 18–21.

When the O/W emulsion dispersion process is used to add the coupler used in the light-sensitive silver halide photographic material according to the present invention, the coupler is usually dissolved in a water-insoluble high-boiling organic solvent with a boiling point of 150° C. or above optionally together with a low-boiling and/or water-soluble organic solvent and emulsifyingly dispersed in a hydrophilic binder such as an aqueous gelatin solution by the use of a surface active agent. As a dispersion means, it is possible to use a stirrer, a homogenizer, a colloid mill, a flow jet mixer, an ultrasonic dispersion machine or the like. After dispersion, or at the same time with the dispersion, the step of removing the low-boiling organic solvent may be inserted. As the high-boiling organic solvent that can be used to dissolve the coupler to effect dispersion, phthalates such as dioctyl phthalate or phosphates such as tricresyl phosphate may preferably be used.

In place of the method in which the high-boiling organic solvent is used, it is also possible to use a method in which the coupler and a polymer compound insoluble-in water and soluble in organic solvent are optionally dissolved in a low-boiling and/or water-soluble organic solvent and emulsifyingly dispersed by means of a dispersion means of various types in a hydrophilic binder such as an aqueous gelatin solution by the use of a surface active agent. The polymer compound insoluble in water and soluble in organic solvent, used here, may include poly(N-t-butyl acrylamide).

For the purpose of shifting absorption wavelength of color forming dyes, compound d-11 disclosed in Japanese Patent O.P.I. Publication No. 114152/1992, page 33, and compound A'-1 disclosed in the same publication, page 35, can be used. Besides, it is possible to use fluorescent dye releasing compounds disclosed in U.S. Pat. No. 4,774,187.

There are no particular limitations on the coating weight of the couplers so long as sufficiently high densities can be obtained. The couplers may each preferably be used in an amount ranging from $1\times10^{-3}$ mol to 5 mols, and more preferably from $1\times10^{-2}$ mol to 1 mol, per mol of silver halide.

In the present invention, an oil-soluble dye may be added. The oil-soluble dye refers to an organic dye having a solubility of 0.01 or less as a solubility in water at 20° C., and compounds having a molecular extinction coefficient of 20,000 or more at the maximum absorption wavelength in a wavelength of 400 nm or longer are preferred. Preferable compounds include the compounds disclosed in Japanese Patent Application No. 1064/1989, page 26, Specific examples of the preferable compounds are compounds 1 to 27 disclosed in the same application, pages 29–32. Of these, compounds 4 and 9 are particularly preferred. The oil-soluble dye may preferably be added to a non-sensitive layer, and may preferably be added in an amount of from 0.05 to 5 mg/m$^2$.

In the light-sensitive silver halide photographic material according to the present invention, it is advantageous to use gelatin as a binder. Other gelatin, gelatin derivatives, graft polymers of gelatin with other macromolecules, and hydrophilic colloids such as proteins other than gelatin, sugar derivatives, cellulose derivatives, and hydrophilic colloids of synthetic hydrophilic polymeric substances such as homo- or copolymers may also be optionally used.

The gelatin may preferably be in a coating weight of not more than 8.0 g/m$^2$ in order to make the present invention more effective against occurrence of stain.

When the light-sensitive material is prepared by coating silver halide emulsions, a thickening agent may be used in order to improve coating performance. As coating processes, extrusion coating and curtain coating are particularly useful, which can perform simultaneous coating of two or more layers.

As aromatic primary amine developing agents used in the present invention, any known compounds may be used. Such compounds can be exemplified by the following compounds.

CD-1) N,N-diethyl-p-phenylenediamine

CD-2) 2-Amino-5-diethylaminotoluene

CD-3) 2-Amino-5-(N-ethyl-N-laurylamino)toluene

CD-4) 4-Amino-3-methyl-N-ethyl-N-(β-butoxyethyl-)aniline

CD-5) 2-Methyl-4-[N-ethyl-N-(β-hydroxyethyl-)amino]aniline

CD-6) 4-Amino-3-methyl-N-ethyl-N-[β-methanesulfonamido)ethyl]aniline

CD-7) N-(2-Amino-5-diethylaminophenylethyl)methanesulfonamide

CD-8) N,N-dimethyl-p-phenylenediamine

CD-9) 4-Amino-3-methyl-N-ethyl-N-methoxyethylaniline

CD-10) 4-Amino-3-methyl-N-ethyl-N-(β-ethoxyethyl)aniline

CD-11) 4-Amino-3-methyl-N-ethyl-N-(β-butoxyethyl)aniline

The color developing agent according to the present invention may usually be used in an amount ranging from $1\times10^{-2}$ to $2\times10^{-1}$ mol per liter of a developing solution, and may preferably be used in an amount ranging from $1.5\times10^{-2}$ to $2\times10^{-1}$ mol per liter of a developing solution from the viewpoint of rapid processing.

The color developing agent used in the present invention may be used alone or in combination with known other p-phenylenediamine derivative.

In the present invention, CD-5, CD-6 and CD-9 are preferred as the color developing agent to be used.

These phenylenediamine derivatives are commonly used in the form of salts such as sulfates, hydrochlorides, sulfites, nitrates and p-toluenesulfonates.

In a preferable developing solution in the present invention, it may preferably contain substantially no benzyl alcohol. What is herein meant by "contain substantially no . . ." is that benzyl alcohol is in a content not more than 2 ml/lit. In the present invention, it is most preferable for the developing solution not to contain it at all.

A color developing solution according to the present invention may be incorporated with the following developing solution components in addition to the above components. As an alkali agent, for example, sodium hydroxide, potassium hydroxide, sodium metaborate, potassium meteborate, trisodium phosphate, tripotassium phosphate, borax and silicate may be used alone or in combination, which may be used in combination so long as no precipitate is produced and the effect of stabilizing the pH can be maintained. In view of necessity for preparation or for the purpose of increasing ionic intensity, it is also possible to use various salts such as disodium hydrogenphosphate, dipotassium hydrogenphosphate, sodium bicarbonate, potassium bicarbonate and borates.

In the color developing solution according to the present invention, hydroxylamine derivatives disclosed in Japanese Patent O.P.I. Publications No. 146043/1988, No. 145042/1988, No. 146041/1988, No. 146040/1988, No. 135938/1988 and No. 118748/1988, and hydroxamic acids, hydrazines, hydrazides, phenols, α-hydroxyketones, α-aminoketones, saccharides, monoamines, diamines, quaternary ammonium salts, nitroxy radicals, alcohols, oximes, diamide compounds and condensed rind type amines disclosed in Japanese Patent O.P.I. Publications No. 62639/1989 and No. 303438/1989 are preferably used as organic preservatives in place of hydroxylamine conventionally used as a preservative.

Any of these compounds, the hydroxylamine conventionally used and the above organic preservatives may be used in combination. In view of development characteristics, however, it is more preferable not to use hydroxylamine.

A development accelerator may also be optionally used. The development accelerator may include, for example, various kinds of pyridinium compounds as typified in U.S. Pat. Nos. 2,648,604 and No. 3,671,247 and Japanese Patent Examined Publication No. 9503/1969, other cationic compounds, cationic dyes such as phenosafranine, neutral salts such as thallium nitrate, polymethylene glycol or derivatives thereof as disclosed in U.S. Pat. Nos. 2,533,990, No. 2,531,832, No. 2,950,970 and No. 2,577,127 and Japanese Patent Examined Publication No. 9504/1969, and nonionic compounds such as polythioethers, organic solvents as disclosed in Japanese Patent Examined Publication No. 9509/1969, as well as ethanolamine, ethylenediamine, diethanolamine and triethanolamine. It may also include phenethyl alcohols disclosed in U.S. Pat. No. 2,304,925, and besides acetylene glycol, methyl ethyl ketone, cyclohexanone, pyridine, ammonia, hydrazine, thioethers and amines.

In the color developing solution according to the present invention, for example, ethylene glycol, methyl cellosolve, methanol, acetone, dimethylformamide, β-cyclodextrin, and other compounds disclosed in Japanese Patent Examined Publications No. 33378/1972 and No. 9509/1969 may also be optionally used as organic solvents for increasing solubility of the developing agent.

An auxiliary developing agent may also be used together with the developing agent. The auxiliary agent is known to include, for example, N-methyl-p-aminophenol sulfates, phenidone, N,N-diethyl-p-aminophenol hydrochlorides and N,N,N',N',-tetramethyl-p-phenylenediamine hydrochlorides. It may be added usually in an amount of from 0.01 to 1.0 g per liter of the developing solution. Besides these, competing couplers, fogging agents, development inhibitor releasing couplers (what is called DIR couplers) and development inhibitor releasing compounds may be optionally added.

It is still also possible to use other various kinds of additives such as antistain agents, antisludge agents and interlayer effect accelerators.

The respective components of the color developing solution may be successively added and stirred in a given quantity of water to prepare the developing solution. In this case, any components having a lower solubility in water may be added after they have been mixed with the organic solvent such as triethanolamine. In more common instances, a plurality of components that can be stably present together one another may be previously prepared in the form of an aqueous concentrated solution or a solid in a small container, followed by addition and stirring in water. Thus, the color developing solution according to the present invention can also be prepared.

The color developing solution according to the present invention may preferably have a sulfite concentration of not more than $1\times10^{-2}$ mol/lit. In particular, it is good for the concentration to be not more than $7\times10^{-3}$ mol/lit including 0, and is particularly preferable for it to be $5\times10^{-3}$ mol/lit including 0.

In the present invention, the color developing solution may be used in any pH range. From the viewpoint of rapid processing, it may preferably be used in a pH range of from 9.5 to 13.0, and more preferably from 9.8 to 12.0.

Color developing according to the present invention may preferably be carried out at a processing temperature of 25° C. or above and 70° C. or below. The higher the temperature is, the shorter-time processing can be carried out. This is preferable, but, in view of the stability of processing solutions, it is more preferable for the temperature not to be so high. The processing may preferably be carried out at 25° C. or above and 50° C. or below.

In the present invention, the color developing may preferably be carried out for a time of from 50 seconds to 120 seconds. Developing time shorter than 50 seconds may result in an unstable maximum density, and developing time longer than 120 seconds is disadvantageous in that fogging tends to occur.

The color developing solution of the present invention may be replenished preferably in an amount of not more than 500 ml, and more preferably from 50 to 400 ml, per 1 $m^2$ of the light-sensitive material.

The processing steps substantially cosist of a color developing step, a bleach-fixing step and a washing step. Any step or steps may be added or replaced with a step or steps having the same meaning, so long as the effect of the present invention is not damaged. For example, the bleach-fixing step may be separated into a bleaching step and a fixing step, or a bleaching step may be provided prior to the bleach-fixing step. In the processing steps used in the present invention, it is preferable to provide the bleach-fixing step immediately after the color developing step.

There are no limitations on a bleaching agent that can be used in a bleach-fixing solution used in the present invention. The bleaching agent may preferably be an organic metal complex salt. The complex salt is a coordination compound comprised of an organic acid as exemplified by polycarboxylic acid, aminopolycarboxylic acid, oxalic acid or citric acid attached to a metal ion such as iron, cobalt or copper. Most preferable organic acids used to form such metals salts of organic acids may include polycarboxylic acids and aminopolycarboxylic acids. These polycarboxylic acids or aminopolycarboxylic acids may also be in the form of alkali metal salts, ammonium salts or water-soluble amine salts.

Specific compounds of these may include compounds 2 to 20 disclosed in Japanese Patent O.P.I. Publication No. 205262/1989, pages 58–59.

The bleaching agent is used in an amount of from 5 to 450 g, and more preferably from 20 to 250 g, per liter of the bleach-fixing solution. The bleach-fixing solution contains a silver halide fixing agent in addition to the bleaching agent as described above, and a solution so composed as to contain a sulfite as a preservative is optionally applied. It is also possible to use a bleach-fixing solution so composed as to contain a halide such as ammonium bromide added in a large amount in addition to a ferric ethylenediaminetetraacetate bleaching agent and the silver halide fixing agent, and also a special bleach-fixing solution so composed as to be in combination of a ferric ethylenediaminetetraacetate bleaching agent and a large amount of a halide such as ammonium bromide. As the halide, ammonium bromide and besides hydrochloric acid, hydrobromic acid, lithium bromide, sodium bromide, potassium bromide, sodium iodide, potassium iodide and ammonium iodide may be used.

The silver halide fixing agent contained in the bleach-fixing solution may typically include compounds capable of forming a water-soluble complex salt upon reaction with silver halide, as used in conventional fixing, and can be exemplified by thiosulfates such as potassium thiosulfate, sodium thiosulfate and ammonium thiosulfate, thiocyanates such as potassium thiocyanate, sodium thiocyanate and ammonium thiocyanate, thioureas, and thioethers. The fixing agent is used in an amount of 5 g or more per liter of the bleach-fixing solution and within the range in which it can be dissolved therein. In usual instances, it is used in an amount of from 70° to 250° g. The bleach-fixing solution may also contain various kinds of buffering agent such as boric acid, borax, sodium hydroxide, potassium hydroxide, sodium carbonate, potassium carbonate, sodium bicarbonate, potassium bicarbonate, acetic acid, sodium acetate and ammonium hydroxide used alone or in combination of two or more kinds. It may also contain a preservative such as hydroxylsmine, hydrazine or a bisulfite addition product of an aldehyde compound, an organic chelating agent such as aminopolycarboxylic acid, a stabilizer such as nitroalcohol or a nitrate, and an organic solvent such as methanol, dimethylsulfonamide or dimethylsulfoxide. To the bleach-fixing solution according to the present invention, various kinds of bleaching accelerator as disclosed in Japanese Patent O.P.I. Publication No. 280/1971, Japanese Patent Examined Publications No. 8506/1970 and No. 555/1971, Belgian Patent No. 770,910, Japanese Patent Examined Publications No. 8836/1970 and No. 9854/1978 and Japanese Patent O.P.I. Publications No. 71634/1979 and No. 42349/1974 may be added.

The bleach-fixing solution is used at a pH of 4.0 or more. It is usually used in a pH range of from 4.0 to 9.5 and preferably from 4.5 to 8.5. Most preferably, it is used in a pH range of from 5.0 to 8.5. It is used at a processing temperature of 80° C. or below, and preferably 55° C. or below, while controlling evaporation or the like. Bleach-fixing may preferably be carried out for a time of 120 seconds or less.

In the photographic processing according to the present invention, washing is carried out subsequently to the color developing and bleach-fixing steps. A preferred embodiment of the washing will be described below.

As a compound preferably used in a washing solution, a chelating agent having a chelate stability constant with respect to iron ions, of not less than 8 is preferable. Here, the chelate stability constant refers to the constant commonly known from L.G. Sillen and A.E. Martell, "Stability Constants of Metal-ion Complexes", The Chemical Society, London (1964), and S. Chaberek and A.E. Martell, "Organic Sequestering Agents", Wiley (1959).

The chelating agent having a chelate stability constant with respect to iron ions, of not less than 8 may include, for example, organic carboxylic acid chelating agents, organic phosphoric acid chelating agents, inorganic phosphoric acid chelating agents and polylhydroxyl compounds. The iron ions refer to ferric ions.

Specific compounds of the chelating agent having a chelate stability constant with respect to ferric ions, of not less than 8 can be exemplified by the compounds disclosed in Japanese Patent O.P.I. Publication No. 205162/1989, page 63, line 15 to page 64, line 17.

The chelating agent may preferably be used in an amount of from 0.01 to 50 g, and more preferably from 0.05 to 20 g, per liter of the washing solution.

Preferred compounds that can be added to the stabilizing solution may include ammonium compounds. These are fed by ammonium salts of various inorganic compounds, which may specifically include, for example, the compounds disclosed in Japanese Patent O.P.I. Publication No. 205162/1989, page 65, line 5 to page 66, line 11. The ammonium compound may preferably be added in an amount of not less than $1.0\times10^{-5}$ mol, more preferably ranging from 0.001 mol to 5.0 mol, and still more preferably ranging from 0.002 mol to 1.0 mols, per liter of the washing solution.

The washing solution should preferably contain a sulfite so long as no bacteria are developed therein. The sulfite incorporated in the washing solution may be any of organic matter and inorganic matter so long as they are capable of releasing sulfite ions. It may preferably include inorganic salts, and preferable specific compounds thereof may include sodium sulfite, potassium sulfite, ammonium sulfite, ammonium bisulfite, potassium bisulfite, sodium bisulfite, sodium metabisulfite, potassium metabisulfite, ammonium metabisulfite, hydrosulfite, glutaraldehyde sodium bisbisulfite, and succinic acid aldehyde sodium bisbisulfite.

The sulfite may preferably be added in an amount of at least $1.0\times10^{-5}$ mol, and more preferably from $5\times1^{-5}$ mol to $1.0\times10^{-1}$ mol, per liter of the washing solution. As methods for its addition, it may be directly added in the washing solution, or may preferably be previously added in a washing replenishing solution.

The washing solution used in the present invention should preferably contain an antifungal agent. This makes it possible to, e.g., prevent sulfiding and improve image storage stability. The antifugal agent usable in the washing solution may include sorbic acid, benzoic acid compounds, phenol compounds, thiazole compounds, pyridine compounds, guanidine compounds, morpholine compounds, quaternary phosphonium compounds, ammonium compounds, urea compounds, isoxazole compounds, propanolamine compounds, sulfamide compounds, pyronone compounds and amino compounds. Specific compounds thereof can be exemplified by the compounds disclosed in Japanese Patent O.P.I. Publication No. 205162/1989, page 68, line 10 to page 72, line 16. Of these compounds, compounds particularly preferably used are thiazole compounds, sulfamide compounds and pyronone compounds.

When added in the washing solution, the antifungal agent may preferably be used in an amount ranging from 0.001 to 30 g, and more preferably from 0.003 to 5 g, per liter of the washing solution.

The washing solution according to the present invention may preferably also contain a metal compound used in combination with the chelating agent. Such a metal compound may include compounds of metals such as Ba, Ca, Ce, Co, In, La, Mn, Ni, Bi, Pb, Sn, Zn, Ti, Zr, Mg, Al and St. The metal compound can be fed in the form of an inorganic or organic salt such as a halide, a sulfate, a carbonate, a phosphate and an acetate or a hydroxides, or in the form of water-soluble chelating agents. Such a compound may preferably be added in an amount of from $1.0\times10^{-4}$ to $1\times10^{-1}$ mol, and more preferably ranging from $4.0\times10^{-4}$ to $2.0\times10^{-2}$ mol, per liter of the washing solution.

As what is contained in the washing solution according to the present invention, a compound having an aldehydo group may be used in addition to the above compounds. Specific compounds thereof may include exemplary compounds 1 to 32 disclosed in Japanese Patent O.P.I. Publication No. 205162/1989, pages 73–75.

The compound having an aldehydo group may preferably be used in an amount ranging from 0.1 to 50 g, and particularly preferably in an amount ranging from 0.5 to 10 g, per liter of the washing solution.

In the washing water according to the present invention, ion-exchanged water may also be used, which is obtained by treating water with an ion-exchange resin.

The washing water applicable in the present invention may have a pH in the range of from 5.5 to 10.0. A pH adjuster applicable in the present invention may include commonly known alkali agents and acid agents, any of which may be used.

Washing may preferably be carried out at a processing temperature of from 15° C. to 60° C., and more preferably in the range of from 20° C. to 45° C. The washing may preferably be carried out for a time of 240 seconds or less. When the washing is carried out using a plurality of tanks, it is preferable for the processing to be carried out in a shorter time in an anterior tank and in a longer time in a posterior tank. It is particularly preferable for the processing to be successively carried out in a processing time which becomes longer by 20% to 50% of that in an anterior tank.

The washing solution in the washing step according to the present invention may preferably be fed, in the case of a multiple-tank counter-flow current system, in the manner that it is fed to a posterior bath and overflows into its anterior bath. The processing may of course be carried out in a single tank. As methods for adding the compound described above, various methods can be used. For example, the compound may be added in a washing tank in the form of a concentrated solution thereof, or the compound and other additives may be added to the washing solution to be fed to the washing tank and the resulting solution may be used as a washing replenishing solution.

The washing water used in the washing step according to the present invention may preferably be in an amount from 0.1 to 50 times, and particularly preferably from 0.5 to 30 times, the amount of water brought into an anterior bath (which is usually a bleach-fixing solution or a fixing solution) per unit area of the light-sensitive material.

The washing tank used in the washing according to the present invention may preferably be comprised of 1 to 5 tanks, and more preferably from 1 to 3 tanks.

As photographic processing apparatus used in the present invention, the apparatus may be of a roller transport type in which light-sensitive materials are held between, and transported through, rollers provided in processing tanks, or an endless belt system in which light-sensitive materials are secured to, and transported on, a belt. It is also possible to use a system in which processing tanks are formed in the form of slits, where processing solutions are fed to such processing tanks and at the same time light-sensitive materials are transported therethrough, a system in which processing solutions are sprayed, a web system in which light-sensitive materials are brought into contact with carriers impregnated with processing solutions, and a system in which viscous processing solutions are used. In the present invention, the invention can be particularly effective when processed after a large quantity of light-sensitive materials have been running-processed through these color developing to drying steps and the dissolution of components from light-sensitive materials to processing solutions, the contamination of processing tanks and the evaporation of processing solutions have become saturated and constant.

EXAMPLES

The present invention will be described below in greater details by living specific examples. Embodiments of the present invention are by no means limited to these.

EXAMPLE 1

On a 180 μm thick transparent polyethylene terephthalate film (BASE-1), silver halide color photographic emulsions were coated as shown in Table 1, to produce sample 1. In the table, the amount of each component added is indicated in g/m². The amount of a silver halide emulsion and that of colloidal silver are each in terms of silver.

The layer constitution and the structures of the compounds used in each layer are as shown below.

TABLE 1

| Layer | Constitution | Amount (g/m²) |
|---|---|---|
| Seventh layer: | Gelatin | 1.00 |

TABLE 1-continued

| Layer | Constitution | Amount (g/m²) |
|---|---|---|
| (Protective layer) | Anti-stain agent HQ-2 | 0.002 |
| | Anti-stain agent HQ-3 | 0.002 |
| | Anti-stain agent HQ-4 | 0.004 |
| | Anti-stain agent HQ-5 | 0.02 |
| | Compounds B, C, D, E | $2 \times 10^{-5}$ each |
| | DIDP | 0.005 |
| | Hardening agent HD-2 | 0.08 |
| | Antifungal agent F-1 | 0.002 |
| Sixth layer: (Ultraviolet absorbing layer) | Gelatin | 0.40 |
| | AI-2 | 0.02 |
| | AI-4 | 0.01 |
| | Ultraviolet absorbent UV-1 | 0.10 |
| | Ultraviolet absorbent UV-2 | 0.04 |
| | Ultraviolet absorbent UV-3 | 0.16 |
| | Anti-stain agent HQ-5 | 0.04 |
| | Compound E | $4 \times 10^{-4}$ |
| | Compounds F, G | $2 \times 10^{-4}$ each |
| | PVP | 0.03 |
| Fifth layer: (Red-sensitive layer) | Gelatin | 4.00 |
| | Red-sensitive silver chlorobromide emulsion Em-R | 0.43 |
| | Cyan coupler C-1 | 0.35 |
| | Cyan coupler C-2 | 0.50 |
| | Dye image stabilizer ST-1 | 0.40 |
| | Anti-stain agent HQ-1 | 0.02 |
| | HBS-1 | 0.40 |
| | DOP | 0.60 |
| Fourth layer: (Ultraviolet absorbing layer) | Gelatin | 2.00 |
| | Ultraviolet absorbent UV-1 | 0.20 |
| | Ultraviolet absorbent UV-2 | 0.20 |
| | Ultraviolet absorbent UV-3 | 0.40 |
| | Anti-stain agent HQ-5 | 0.10 |
| | Compound E | $1 \times 10^{-3}$ |
| Third layer: (Green-sensitive layer) | Gelatin | 3.00 |
| | AI-1 | 0.01 |
| | Green-sensitive silver chlorobromide emulsion Em-G | 0.52 |
| | Magenta coupler M-1 | 0.70 |
| | Dye image stabilizer ST-3 | 0.40 |
| | Dye image stabilizer ST-4 | 0.20 |
| | Dye image stabilizer ST-5 | 0.20 |
| | Anti-stain agent HQ-1 | 0.02 |
| | DOP | 0.60 |
| Second layer: (Intermediate layer) | Gelatin | 1.20 |
| | AI-3 | 0.01 |
| | Anti-stain agent HQ-2 | 0.03 |
| | Anti-stain agent HQ-3 | 0.03 |
| | Anti-stain agent HQ-4 | 0.05 |
| | Anti-stain agent HQ-5 | 0.23 |
| | Compounds B, C, D, E | $3 \times 10^{-4}$ each |
| | DIDP | 0.06 |
| | Fluorescent brightener W-1 | 0.10 |
| | Antifungal agent F-1 | 0.02 |
| First layer: (Blue-sensitive layer) | Gelatin | 2.60 |
| | Blue-sensitive silver chlorobromide emulsion Em-B | 0.61 |
| | Yellow coupler Y-1 | 1.60 |
| | Dye image stabilizer ST-1 | 0.60 |
| | Dye image stabilizer ST-2 | 0.40 |
| | Anti-stain agent HQ-1 | 0.40 |
| | Compound A | $4 \times 10^{-4}$ |
| | DNP | 0.40 |
| Support: | Transparent polyethylene terephthalate BASE-1 | |
| First back layer: | Gelatin | 3.00 |
| | Ultraviolet absorbent UV-1 | 0.20 |
| | Ultraviolet absorbent UV-2 | 0.10 |
| | Ultraviolet absorbent UV-3 | 0.30 |
| | Colloidal silver | 0.10 |
| Second back layer: (Protective layer) | Gelatin | 2.00 |
| | Colloidal silver | 0.05 |
| | Hardening agent HS-2 | 0.06 |

Y-1
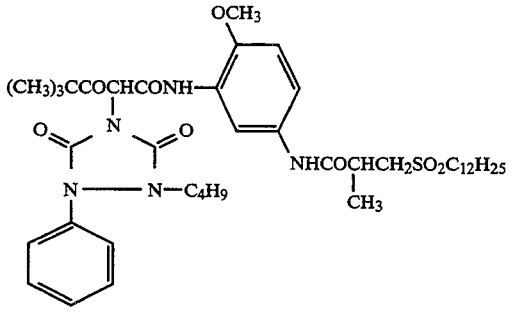
M-1
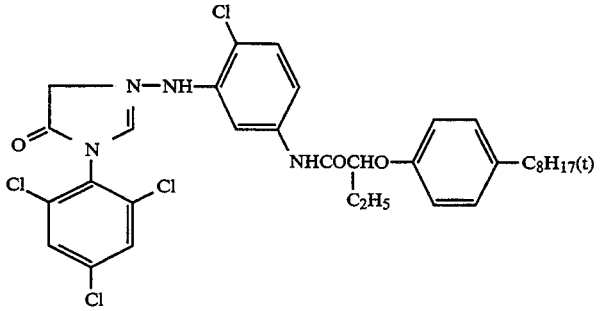
C-1
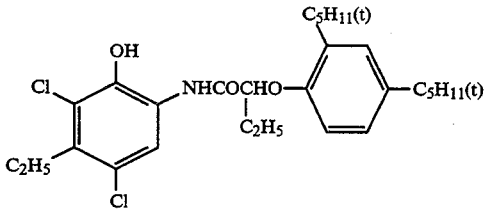
C-2
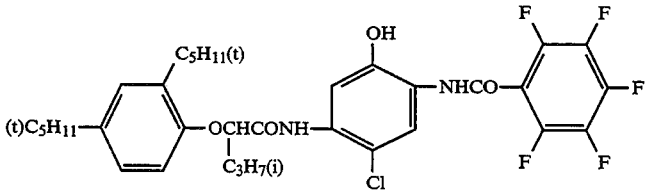
ST-1
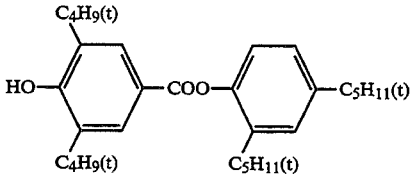
ST-2
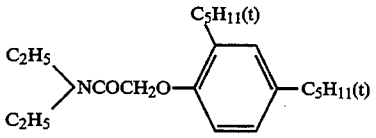
ST-3
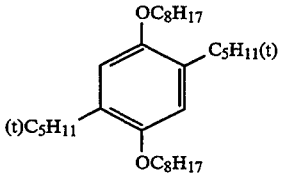

-continued
ST-4
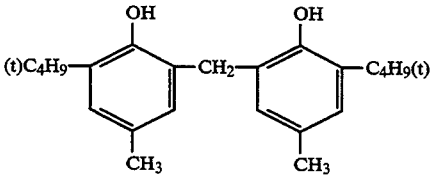
ST-5
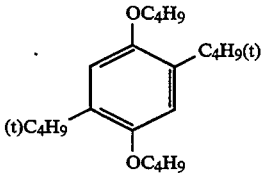
UV-1
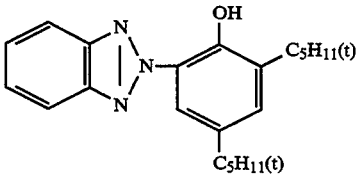
UV-2
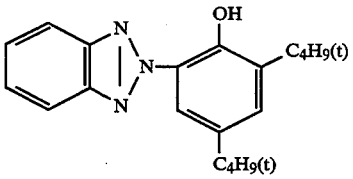
UV-3
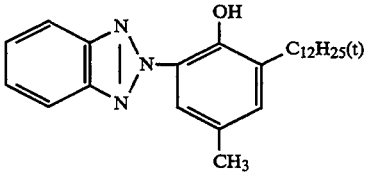
DBP: Dibutyl phthalate
DOP: Dioctyl phthalate
DNP: Dinonyl phthalate
DIDP: Diisodecyl phthalate
PVD: Polyvinyl pyrrolidone
W-1
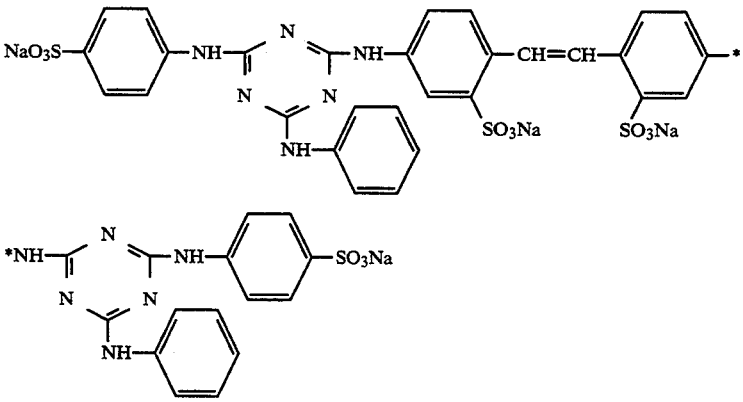
F-1
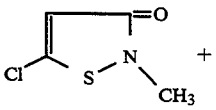
(50%)

-continued
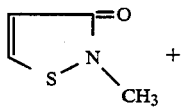
(46%)
+
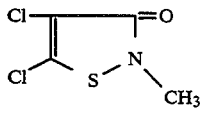
(4%)
molar ratio
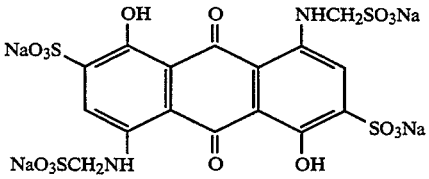
AI-4
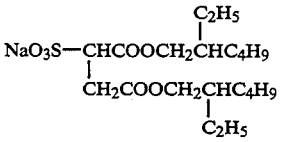
SU-2
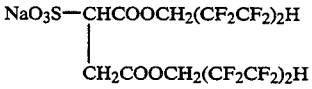
SU-3
$C(CH_2SO_2CH{=}CH_2)_4$
H-1
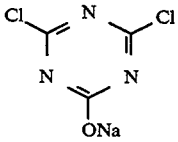
HD-2
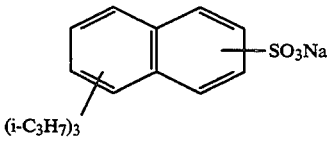
SU-1
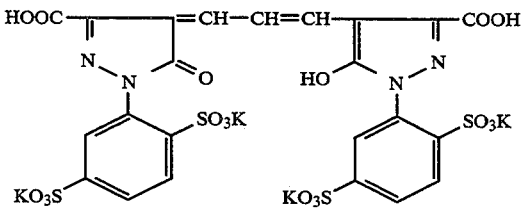
AI-1
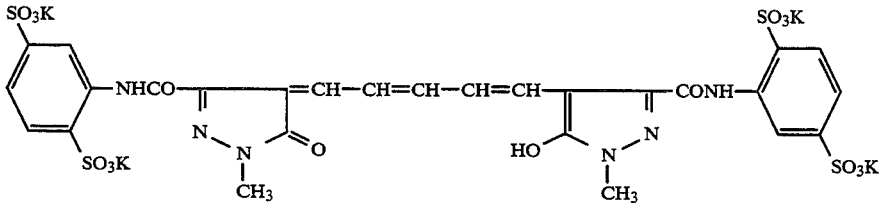
AI-2

-continued
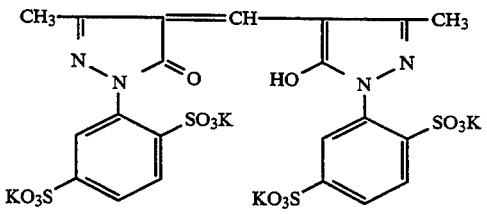
AI-3
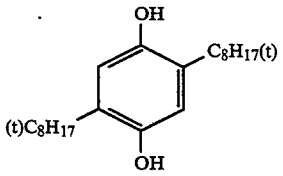
HQ-1
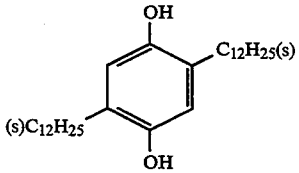
HQ-2
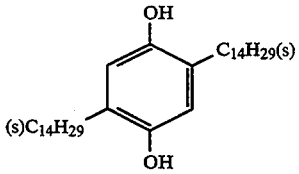
HQ-3
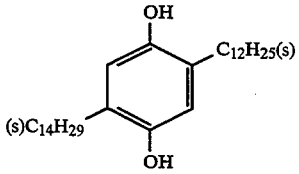
HQ-4
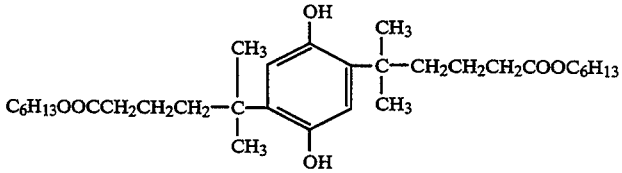
HQ-5
(Quinone compounds of HQ-1, HQ-2, HQ-3, HQ-4 and HQ-5, respectively) Compounds A,B,C,D & E
Compound F
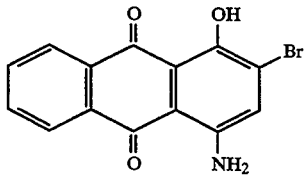
Compound G
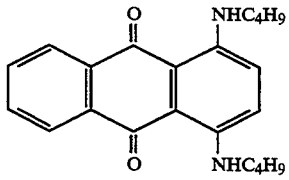
HBS-1
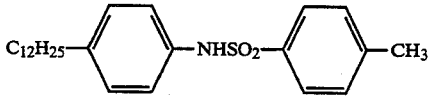

Preparation of blue-sensitive silver halide emulsion

In 1,000 ml of an aqueous 2% gelatin solution kept at a temperature of 40° C., the following solution A and solution B were simultaneously added over a period of 30 minutes while controlling the pAg and pH to be 6.5 and 3.0, respectively, and the following solution C and solution D were further simultaneously added over a period of 180 minutes while controlling the pAg and pH to be 7.3 and 5.5, respectively. At this time, the pAg was controlled by the method disclosed in Japanese Patent O.P.I. Publication No. 45437/1984 and the pH was controlled using an aqueous solution of sulfuric acid or sodium hydroxide.

| | |
|---|---|
| Solution A: | |
| Sodium chloride | 3.42 g |
| Potassium bromide | 0.07 g |
| By adding water, made up to | 200 ml |
| Solution B: | |
| Silver nitrate | 10.0 g |
| By adding water, made up to | 200 ml |
| Solution C: | |
| Sodium chloride | 102.7 g |
| Potassium bromide | 2.10 g |
| By adding water, made up to | 600 ml |
| Solution D: | |
| Silver nitrate | 300 g |
| By adding water, made up to | 600 ml |

After completion of the addition, the emulsion was desalted using an aqueous 5% solution of DEMOL-N, produced by Kao Atlas Co, and an aqueous 20% solution of magnesium sulfate, and then mixed with an aqueous gelatin solution to give a monodisperse cubic emulsion EMP-1 having an average grain size of 0.85 μm, a coefficient of variation (S/R) of 0.05 and a silver chloride content of 99.0 mol %.

The emulsion EMP-1 was subjected to chemical ripening at 50° C. for 90 minutes using the following compounds to give a blue-sensitive silver halide emulsion Em-B1.

| | |
|---|---|
| Sodium thiosulfate | 0.8 mg/mol · AgX |
| Chloroauric acid | 0.5 mg/mol · AgX |
| Stabilizer STAB-1 | $6 \times 10^{-4}$ mol/mol · AgX |
| Spectral sensitizer BS-1 | $4 \times 10^{-4}$ mol/mol · AgX |
| Spectral sensitizer BS-2 | $1 \times 10^{-4}$ mol/mol · AgX |

Preparation of green-sensitive silver halide emulsion

The preparation of EMP-1 was repeated except that the addition time of the solutions A and B and the addition time of the solutions C and D were changed, to give a monodisperse cubic emulsion EMP-2 having an average grain size of 0.43 μm, a coefficient of variation (S/R) of 0.07 and a silver chloride content of 99.0 mol %.

The emulsion EMP-2 was also subjected to chemical ripening at 55° C. for 120 minutes using the following compounds to give a green-sensitive silver halide emulsion Em-G1.

| | |
|---|---|
| Sodium thiosulfate | 1.5 mg/mol · AgX |
| Chloroauric acid | 1.0 mg/mol · AgX |
| Stabilizer STAB-1 | $6 \times 10^{-4}$ mol/mol · AgX |
| Spectral sensitizer GS-1 | $4 \times 10^{-4}$ mol/mol · AgX |

BS-1

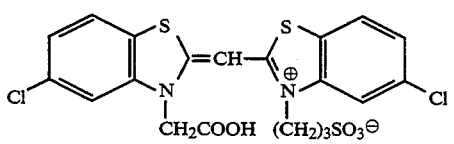

BS-2

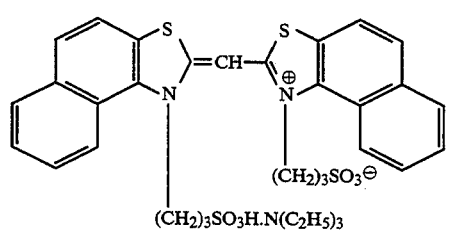

GS-1

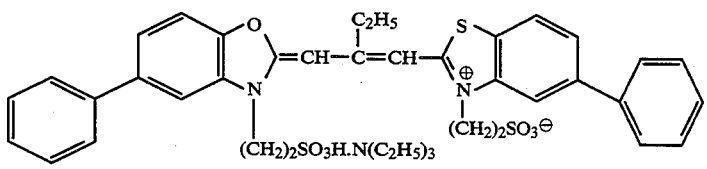

RS-1

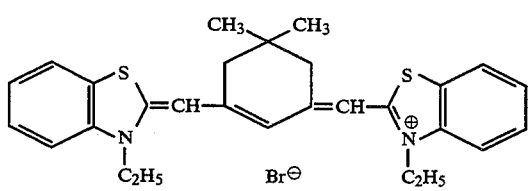

STAB-1

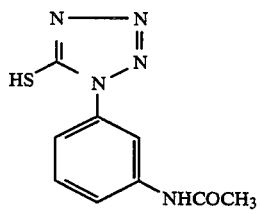

Preparation of red-sensitive silver halide emulsion

The preparation of EMP-1 was repeated except that the addition time of the solutions A and B and the addition time of the solutions C and D were changed, to give a monodisperse cubic emulsion EMP-3 having an average grain size of 0.50 μm, a coefficient of variation (S/R) of 0.08 and a silver chloride content of 99.0 mol %.

The emulsion EMP-3 was also subjected to chemical ripening at 60° C. for 90 minutes using the following compounds to give a red-sensitive silver halide emulsion Em-R1.

| | |
|---|---|
| Sodium thiosulfate | 1.8 mg/mol · AgX |
| Chloroauric acid | 2.0 mg/mol · AgX |
| Stabilizer STAB-1 | $6 \times 10^{-4}$ mol/mol · AgX |
| Spectral sensitizer RS-1 | $1 \times 10^{-4}$ mol/mol · AgX |

In 1,000 ml of an aqueous 2% gelatin solution kept at a temperature of 40° C., the following solution E and solution F were simultaneously added over a period of 30 minutes while controlling the pAg and pH to be 6.5 and 3.0, respectively, and the following solution G and solution H were further simultaneously added over a period of 180 minutes while controlling the pAg and pH to be 7.3 and 5.5, respectively. At this time, the pAg was controlled by the method disclosed in Japanese Patent O.P.I. Publication No. 45437/1984 and the pH was controlled using an aqueous solution of sulfuric acid or sodium hydroxide. Subsequently, solution I and solution J were simultaneously added over a period of 2 minutes. Thus, a monodisperse cubic emulsion EMP-4 having an average grain size of 0.43 μm, a coefficient of variation (S/R) of 0.08 and a silver chloride content of 99.0 mol % was obtained. Analysis made utilizing X-rays revealed that the maximum value of silver bromide content at the portion containing silver bromide at a high concentration was 61 mol %.

| | |
|---|---|
| Solution E: | |
| Sodium chloride | 3.44 g |
| By adding water, made up to | 200 ml |
| Solution F: | |
| Silver nitrate | 9.9 g |
| By adding water, made up to | 200 ml |
| Solution G: | |
| Sodium chloride | 103.2 g |
| Solution K | 50 ml |
| By adding water, made up to | 600 ml |
| Solution H: | |
| Silver nitrate | 297 g |
| By adding water, made up to | 600 ml |
| Solution I: | |
| Potassium bromide | 2.17 g |
| By adding water, made up to | 15 ml |
| Solution J: | |
| Silver nitrate | 3.1 g |
| By adding water, made up to | 15 ml |
| Solution K: | |
| 1-Phenyl-5-mercaptotetrazole methanol solution (1%) | |

The preparation of sample 1 was repeated except that the first back layer and the second back layer were removed and the support was changed as shown in Table 4, to produce samples 2 to 10. The preparation of sample 1 was also repeated except that an OG layer and a white-pigment layer were provided between the support BASE-1 and the first layer, to produce sample 11.

TABLE 2

| Layer | Constitution | Amount (g/m²) |
|---|---|---|
| OG layer: | Gelatin | 1.5 |
| | Surface active agent SF-3 | 0.03 |
| | Hardening agent H-1 | 0.05 |
| White-pigment layer: | Gelatin | 2.0 |
| | Rutile type titanium oxide | 0.40 |
| | Surface active agent SF-1 | |
| Support: | Transparent polyethylene terephthalate BASE-1 | |

TABLE 2-continued

| Processing steps | Processing temperature | Time | Amount for replenishment |
|---|---|---|---|
| Processing steps A | | | |
| Color developing A | 35.0 ± 0.3° C. | 110 sec. | 377 ml/m² |
| Bleach-fixing A | 35.0 ± 0.5° C. | 110 sec. | 495 ml/m² |
| Washing A | 30 to 34° C. | 3 min. 490 sec. | 570 ml/m² |
| Drying | 60 to 80° C. | 150 sec. | |

Processing solutions each had the composition shown below.

| Color developing solution A, tank solution | |
|---|---|
| Pure water | 800 ml |
| Potassium bromide | 20 mg |
| Potassium chloride | 3.0 g |
| Potassium sulfite | 0.25 g |
| N-ethyl-N-(β-methanesulfonamidoethyl)-3-methyl-4-aminoaniline sulfate | 4.5 g |
| N,N-diethylhydroxylamine | 5.0 g |
| Triethanolamine | 10.0 g |
| Sodium diethylenetriaminepentaacetate | 2.0 g |
| Hydroxylamine disulfonate | 2.0 g |
| Fluorescent brightener (4,4'-diaminostilbenesulfonic acid derivative) | 2.0 g |
| Potassium carbonate | 27 g |

Made up to 1 liter in total by adding water, and adjusted to pH 10.10.

| Color developing solution A, replenishing solution | |
|---|---|
| Pure water | 800 ml |
| Potassium sulfite | 0.5 g |
| N-ethyl-N-(β-methanesulfonamidoethyl)-3-methyl-4-aminoaniline sulfate | 9.2 g |
| N,N-diethylhydroxylamine | 9.0 g |
| Triethanolamine | 15.0 g |
| Sodium diethylenetriaminepentaacetate | 2.0 g |
| Hydroxylamine disulfonate | 3.0 g |
| Fluorescent brightener (4,4'-diaminostilbenesulfonic acid derivative) | 2.5 g |
| Potassium carbonate | 30 g |

Made up to 1 liter in total by adding water, and adjusted to pH 10.60.

| Bleach-fixing solution A, tank solution & replenishing solution | |
|---|---|
| Ferric ammonium ethylenediaminepentaacetate dihydrate | 65 g |
| Diethylenetriaminepentaacetic acid | 3 g |
| Ammonium thiosulfate (aqueous 70% solution) | 100 ml |
| 5-Amino-1,3,4-thiadiazole-2-thiol | 2.0 g |
| Ammonium sulfite (aqueous 40% solution) | 27.5 ml |

Made up to 1 liter in total by adding water, and adjusted to pH 6.5 using potassium carbonate or glacial acetic acid.

| Washing solution A, tank solution & replenishing solution | |
|---|---|
| Ortho-phenylphenol | 1.0 g |
| 5-Chloro-2-methyl-4-isothiazolin-3-one | 0.02 g |
| 2-Methyl-4-isothiazolin-3-one | 0.02 g |

-continued

| Washing solution A, tank solution & replenishing solution | |
|---|---|
| Diethylene glycol | 1.0 g |
| Fluorescent brightener (TINOPAL SFP) | 2.0 g |
| 1-Hydroxyethylidene-1,1-diphosphonic acid | 1.8 g |
| $BiCl_3$ (aqueous 45% solution) | 0.65 g |
| $MgSO_4.7H_2O$ | 0.2 g |
| PVP (polyvinyl pyrrolidone) | 1.0 g |
| Ammonia water (aqueous 25% ammonium hydroxide solution) | 2.5 g |
| Trisodium nitrilotriacetate | 1.5 g |

Made up to 1 liter in total by adding water, and adjusted to pH 7.5 using sulfuric acid or ammonia water.

BASE 2

A paper stuff was prepared by mixing 20% of needle-leaved tree bleached sulfite process pulp (NBSP) having been beated to a Canadian Standard freeness (JIS P-8121-76) of 250 ml by means of a refiner and 80% of broad-leaved tree bleached sulfate process pulp (LBKP) having been beated to a like freeness of 280 ml.

Paper additives were used in amounts of the following composition, based on the born dry weight of the pulp.

| | |
|---|---|
| Cationized starch | 2.0% |
| Alkylketene dimer resin | 0.4% |
| Anionic polyacrylamide resin | 0.1% |
| Polyamide-polyamine-epichlorohydrin resin | 0.7% |

Adjusted to pH 7.5 using sodium hydroxide.

The paper stuff containing the above additives was set on a Fourdrinier machine to carry out papermaking, followed by size pressing and machine calendering to produce a base paper with a U.S. basis weight of 90 g/m$^2$, a bulk density of 1.0 and a water content of 8%.

A 5% size solution prepared by dissolving carboxyl-modified PVA and sodium chloride in a ratio of 2:1 in water was used as a size press treatment agent, which was coated on both sides of the base paper in a coating weight of 2.2 g/m$^2$ each.

Both sides of the base paper thus obtained were subjected to corona discharging. On the top surface thereof, a 30 μm thick resin coat layer comprised of a high-density polyethylene (specific gravity: 0.94; MI: 6.8) containing anatase type titanium dioxide in a concentration of 10% was formed by extrusion coating. On the back surface thereof, a polyethylene resin coat layer was formed by co-extrusion coating. The resulting multilayered material was pressed at a linear pressure of 20 kg/cm against a cleaning roll having a 20° C. matte surface to produce an extruded photographic paper support.

Here, the photographic paper support had a thickness of 140 μm.

BASE-3

A paper stuff was prepared by mixing 20% of needle-leaved tree bleached sulfite process pulp (NBSP) having been beated to a Canadian Standard freehess (JIS P-8121-76) of 250 ml by means of a refiner and 804 of broad-leaved tree bleached sulfate process pulp (LBKP) having been beated to a like freeness of 280 ml.

Paper additives were used in amounts of the following composition, based on the born dry weight of the pulp.

| | |
|---|---|
| Cationized starch | 2.0% |
| Alkylketene dimer resin | 0.4% |
| Anionic polyacrylamide resin | 0.1% |
| Polyamide-polyamine-epichlorohydrin resin | 0.7% |
| Sodium hydroxide | for adjustment to pH 7.5 |

The paper stuff containing the above additives was set on a Fourdrinier machine to carry out papermaking, followed by size pressing and machine calendering to produce a base paper with a U.S. basis weight of 170 g/m$^2$, a bulk density of 1.0 and a water content of 8%.

A 5% size solution prepared by dissolving carboxyl-modified PVA and sodium chloride in s ratio of 2:1 in water was used as a size press treatment agent, which was costed on both sides of the base paper in a coating weight of 2.2 g/m$^2$ each. As a release agent, carboxymethyl cellulose (molecular weight: 300,000) was also costed on the side on which silver halide emulsion layers were costed).

Both sides of the base paper thus obtained were subjected to corona discharging. On the top surface thereof, a 35 μm thick resin coat layer comprised of a high-density polyethylene (specific gravity: 0.94; MI: 6.8) containing anatase type titanium dioxide in a concentration of 13% was formed by extrusion costing. On the back surface thereof, a polyethylene resin cost layer with an upper and lower double layer structure was formed by co-extrusion coating under condition of 280° C., using polyethylene containing no titanium dioxide. The resulting multilayered material was pressed at a linear pressure of 20 kg/cm against a cleaning roll having a 20° C. matte surface to produce an extruded photographic paper support. The peel strength was controlled to be 74 g/inch.

Here, this support had s thickness of 230 μm.

BASE-4, BASE-5 end BASE-6 having different peel strengths were produced in the same manner as BASE-3.

EVALUATION METHODS

Maximum color transmission density

Each sample was exposed to white light and then processed according to the processing steps A. On the samples thus processed, yellow, green and cyan transmission densities were measured using PDA-65. From the value obtained, maximum density of each sample was subtracted.

AUTOMATIC PROCESSOR ADAPTABILITY

Transport performant

Each sample was cut into a size of 254 mm×305 mm, and processed using a sheet automatic processor to make evaluation of transport performance.

C: An edge of the sample is broken and the sample stops on the way of processing.

A: The sample can be processed without any problem at all.

Transmission view

Each sample was cut into a size of 254 mm×305 mm and thereafter photographically imagewise printed, followed by color developing. The prints obtained were visually evaluated using ILLUMIX II (manufactured by Eastman Kodak Co. ).

Clearness

C: Clearness is very poor.
B: Clearness is a little poor.
A: Clearness is so much food as to provide a very clear view.

Image quality

C: Poor
B: Good
A: Excellent

General purpose properties

Each sample was processed and thereafter stuck to tent cloth, paper, etc. to make evaluation of general-purpose properties.

Samples 3 to 10 making use of BASE-3 were tested after their supports were each peeled at the interface between the polyolefin layer on the emulsion layer side and the base paper.

C: The sample can be stuck with difficulty.
B: The sample can be stuck with a little difficulty.
A: The sample can be stuck with ease.

Anti-curl performance test

Samples of light-sensitive silver halide photographic materials having been photographically processed were left to stand for 3 hours in a low-humidity environment of 23° C. and 20% RH, and thereafter the numerical curl value of each sample was measured. The numerical curl value herein referred to is expressed as a reciprocal of a curvature radius. Here, the samples used were all those cut into a uniform size of 11.7 cm×8.2 cm.

Peel strength

Samples of 610 mm in width were cut into a width of 1 inch. On all the resulting samples, measurement was made according to American Society for Testing and Materials ASTM D-903, and the measurements were averaged. It has been ascertained that samples with a peel strength of less than 40 g/inch cause separation when handled other than when the support must be peeled, and those of 160 g/inch or more make the support difficult to peel and cause extension or break, briging about problems in practical use.

Results obtained are shown in Table 3.

TABLE 3

| Sample | Support | Peel strength (g/in.) | Silver coating weight* ($g/m^2$) Y | M | C | Total | Maximum color transmission density Y | M | C | (1) | *Transmission view (2) | (3) | Anti-curl performance (l/m) | (4) |
|---|---|---|---|---|---|---|---|---|---|---|---|---|---|---|
| 1 | BASE-1(X) | — | 0.61 | 0.52 | 0.43 | 1.56 | 2.84 | 3.00 | 3.06 | A | A | A | 14.0 | C |
| 2 | BASE-2(X) | — | 0.61 | 0.52 | 0.43 | 1.56 | 2.82 | 2.99 | 3.03 | C | B | C | 42.5 | B |
| 3 | BASE-3(X) | 74 | 0.27 | 0.21 | 0.21 | 0.72 | 1.78 | 1.88 | 1.99 | A | A | C | 14.1 | A |
| 4 | BASE-3(X) | 74 | 0.32 | 0.31 | 0.30 | 0.93 | 1.99 | 2.19 | 2.38 | A | A | B | 14.0 | A |
| 5 | BASE-3(Y) | 74 | 0.53 | 0.41 | 0.36 | 1.30 | 2.51 | 2.55 | 2.69 | A | A | A | 14.0 | A |
| 6 | BASE-3(Y) | 74 | 0.61 | 0.52 | 0.43 | 1.56 | 2.81 | 2.98 | 3.03 | A | A | A | 14.0 | A |
| 7 | BASE-3(Y) | 74 | 0.70 | 0.61 | 0.56 | 1.87 | 3.01 | 3.23 | 3.30 | A | A | A | 14.2 | A |
| 8 | BASE-4(X) | 240 | 0.61 | 0.52 | 0.43 | 1.56 | 2.81 | 2.98 | 3.03 | A | A | A | 14.3 | C |
| 9 | BASE-5(X) | 200 | 0.61 | 0.52 | 0.43 | 1.56 | 2.81 | 2.98 | 3.03 | A | A | A | 14.3 | C |
| 10 | BASE-6(X) | 170 | 0.61 | 0.52 | 0.43 | 1.56 | 2.81 | 2.98 | 3.03 | A | A | A | 14.2 | C |
| 11 | BASE-1(Y) | — | 0.61 | 0.52 | 0.43 | 1.56 | 2.89 | 3.08 | 3.10 | A | B | A | 14.4 | C |

(1) Adaptability to automatic processor
(2) Clearness
(3) Image quality
(4) General-purpose properties
*In samples 3 to 10, the maximum color transmission density and the clearness and image quality in transmission view are evaluated after the support has been removed.

As is seem from the results shown in Table 3, sample 1 and/or sample 11 making use of a comparative example BASE-1 have no general-purpose properties. Sample 2 making use of BASE-2 has a poor transport performance, an inferior anti-curl performance and also a poor image quality in transmission view.

On the other hand, samples 5 to 7 making use of BASE-3 of the present invention and having a total silver coating weight of 1.0 g/m2 or more have a superior transport performance, a good clearness and image quality in transmission view, a superior anti-curl performance and also a greater general-purpose properties. Samples 8 and 9 having a peel strength outside the present invention make the support not easy to peel and have inferior general-purpose properties.

EXAMPLE 2

Evaluation was made in the same manner as in Example 1 except that in the constitution of samples 1 to 10 in Example 1 the yellow coupler was replaced with Y-2 to Y-7, the magenta coupler with M-2 to M-7, and the cyan coupler with C-3 to C-10.

As a result, the effect of the present invention was obtained when the yellow coupler, magenta coupler and cyan coupler were changed.

Y-2

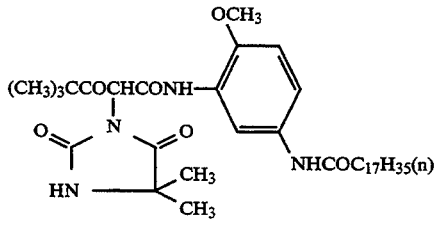

-continued
Y-3
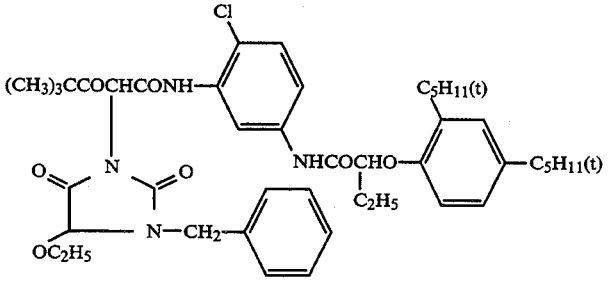
Y-4
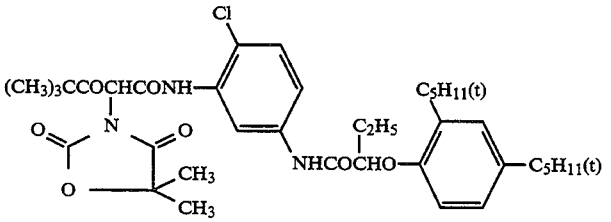
Y-5
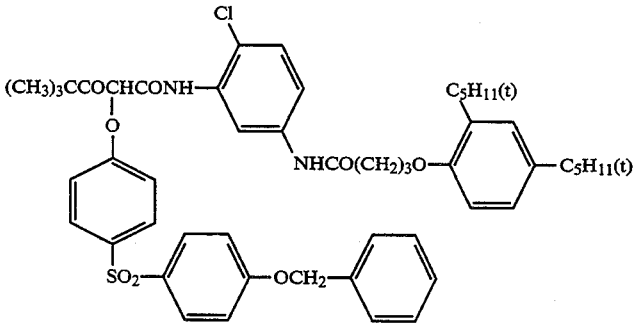
Y-6
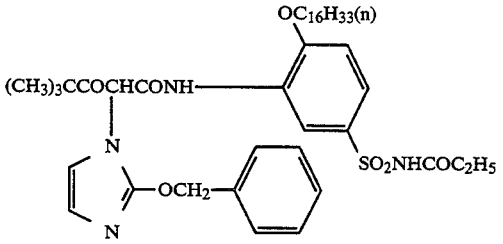
Y-7
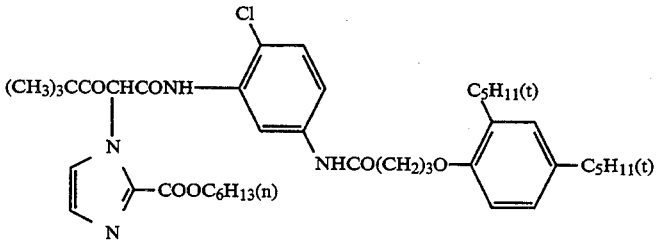
M-2
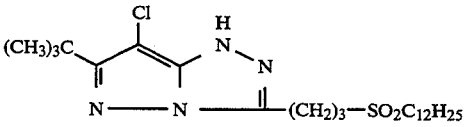
The silver coating weight in the third layer was changed to 0.25 g/m$^2$.
M-3
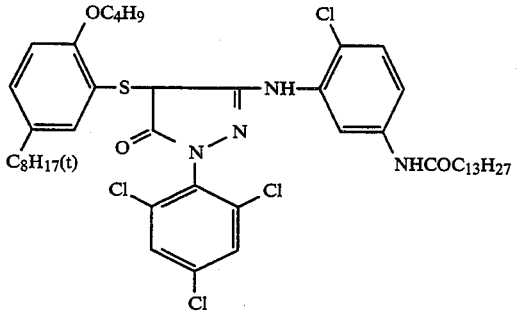
The silver coating weight in the third layer was changed to 0.25 g/m$^2$.

-continued
M-4
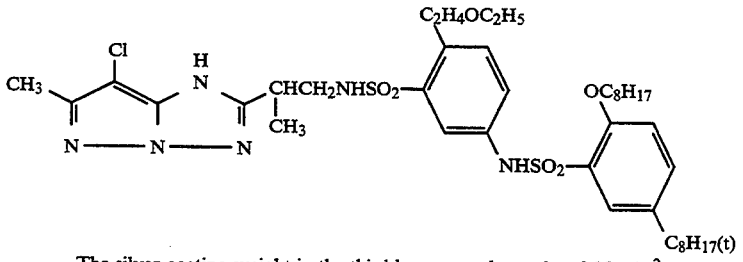
The silver coating weight in the third layer was changed to 0.25 g/m$^2$.
M-5
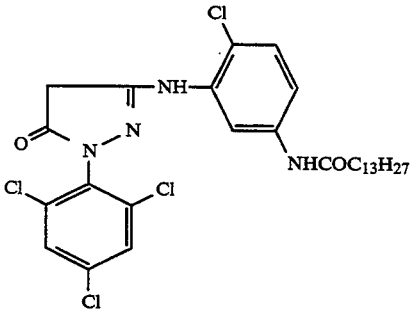
M-6
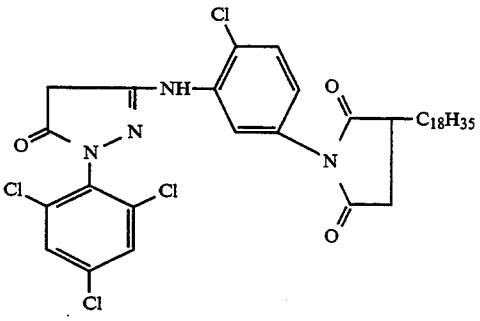
M-7
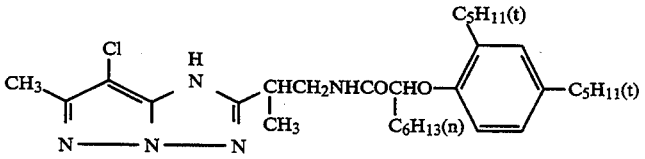
The silver coating weight in the third layer was changed to 0.25 g/m$^2$.
C-3
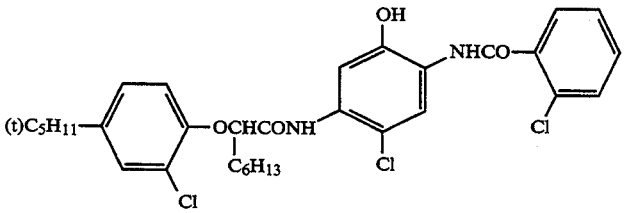
C-4
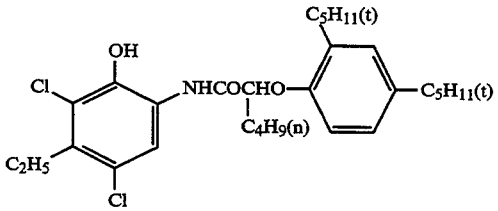
C-5
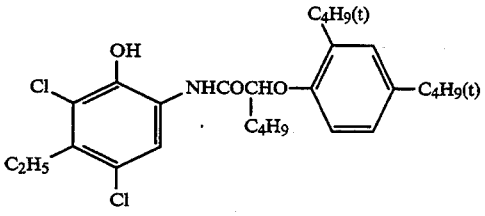
C-6
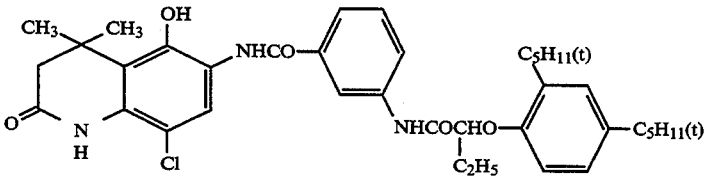
C-7
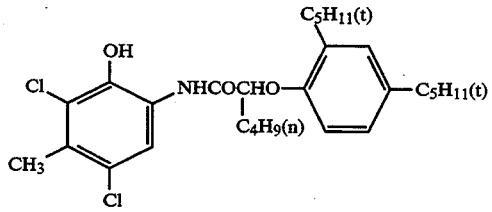
C-8
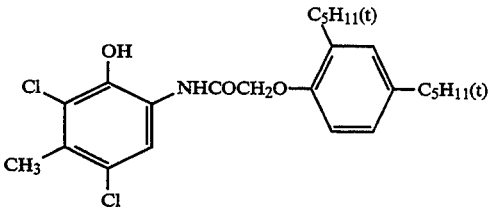

-continued

C-9

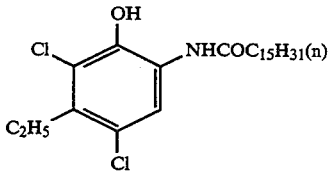

C-10

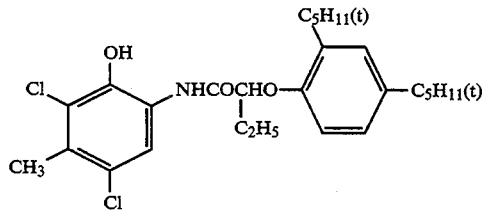

As described above, the light-sensitive silver halide color photographic material has a superior image quality when light-transmitted from the back, and has an adaptability to automatic processors, a superior anti-curl performance and high general-purpose properties.

What is claimed is:

1. A silver halide photographic light-sensitive material comprising a base paper support coated with a hydrophilic polymer as a peeling agent, and having thereon, a polyolefin resin layer, and at least one silver halide emulsion layer, wherein the hydrophilic polymer is coated on the side on which the silver halide emulsion layer is provided, and a peel strength between the base paper support and the polyolefin resin layer is within the range of 30 to 160 g in weight per inch, and a maximum color transmission density is not less than 2.0 when the silver halide light-sensitive material is subjected to a color developing.

2. The silver halide photographic light-sensitive material of claim 1, wherein the peel strength between the base paper support and the polyolefin resin layer is within the range of 40 to 120 g in weight per inch.

3. The silver halide photographic light-sensitive material of claim 1, wherein the hydrophilic polymer is selected from the group consisting of high molecular compound containing cellulose as constituent, high molecular compound containing vinyl acetate as a constituent, high molecular compound containing vinyl alcohol as a constituent and high molecular compound containing acrylic acid or maleic acid as a constituent.

4. The silver halide photographic light-sensitive material of claim 3, wherein the high molecular containing cellulose as a constituent is a cellulose ethers or a cellulose esters having a molecular weight of from 1,000 to 1,000,000.

5. The silver halide photographic light-sensitive material of claim 4, wherein the high molecular containing cellulose as a constituent is selected from the group consisting of methyl cellulose, ethyl cellulose, benzyl cellulose, carboxymethyl cellulose, acetyl cellulose, cellulose sulfate and cellulose phthalate.

6. The silver halide photographic light-sensitive material of claim 3, wherein the high molecular compound containing vinyl acetate as a constituent is selected from the group consisting of polyvinyl acetate, an ethylene-vinyl acetate copolymer, a carboxy-modified ethylene-vinyl acetate copolymer, a vinyl acetate-acrylic acid copolymer and a vinyl acetate-maleic acid copolymer.

7. The silver halide photographic light-sensitive material of claim 3, wherein the high molecular compound containing vinyl alcohol as a constituent is polyvinyl alcohol or copolymers of vinyl alcohol.

8. The silver halide photographic light-sensitive material of claim 3, wherein the high molecular compound containing acrylic acid or maleic acid as a constituent is selected from the group consisting of polyacrylic acid, sodium polyacrylate, polymethyl acrylate, polymaleic acid, polymethyl maleate and a sulfone-maleic acid copolymer.

9. The silver halide photographic light-sensitive material of claim 1, wherein the coated amount of the hydrophilic polymer is within the range of 0.5 to 1.5 $g/m^2$ on the surface of the base paper support.

10. The silver halide photographic light-sensitive material of claim 1, wherein the maximum color transmission density is not less than 2.2.

11. The silver halide photographic light-sensitive material of claim 1, wherein a total silver coating weight is not less than 1.0 $g/m^2$.

12. The silver halide photographic light-sensitive material of claim 1, wherein a total silver coating weight is not less than 1.2 $g/m^2$.

13. A silver halide photographic light-sensitive material comprising a base paper support coated with a hydrophilic polymer as a peeling agent, and having thereon, a polyolefin resin layer, and at least one silver halide emulsion layer, wherein the hydrophilic polymer is coated on the side on which the silver halide emulsion layer is provided, and a peel strength between the base paper support and the polyolefin resin layer is within the range of 40 to 120 g in weight per inch, and a maximum color transmission density is not less than 2.0 when the silver halide light-sensitive material is subjected to a color developing.

* * * * *